US006474070B1

(12) United States Patent
Danis et al.

(10) Patent No.: US 6,474,070 B1
(45) Date of Patent: Nov. 5, 2002

(54) RICH DOUBLE DOME COMBUSTOR

(75) Inventors: Allen M. Danis, Mason, OH (US); Byron A. Pritchard, Jr., Loveland, OH (US); Keith K. Taylor, Mason, OH (US); Richard W. Stickles, Loveland, OH (US); Willard J. Dodds, West Chester, OH (US); Donald L. Gardner, West Chester, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/095,209

(22) Filed: Jun. 10, 1998

(51) Int. Cl.[7] ..... F02G 3/00
(52) U.S. Cl. ..... 60/739; 60/754
(58) Field of Search ..... 60/739, 747, 756, 60/754

(56) References Cited

U.S. PATENT DOCUMENTS

| | | | | | |
|---|---|---|---|---|---|
| 5,231,833 | A | * | 8/1993 | MacLean et al. | 60/734 |
| 5,237,820 | A | * | 8/1993 | Kastl et al. | 60/752 |
| 5,241,827 | A | * | 9/1993 | Lampes | 60/754 |
| 5,289,685 | A | * | 3/1994 | Hoffa | 60/739 |
| 6,070,412 | A | * | 6/2000 | Ansart et al. | 60/747 |

* cited by examiner

*Primary Examiner*—Ehud Gartenberg
(74) *Attorney, Agent, or Firm*—Rodney M. Young; Francis L. Conte; William Scott Andes

(57) ABSTRACT

A gas turbine engine combustor includes outer and inner liners joined together at an annular dome. Outer and inner air swirlers and cooperating fuel injectors are mounted in two rows in the combustor dome. The fuel injectors are joined to a common fuel manifold for simultaneously channeling fuel thereto over an operating range from idle to full power for reducing exhaust emissions.

20 Claims, 2 Drawing Sheets

RICH DOUBLE DOME COMBUSTOR

BACKGROUND OF THE INVENTION

The present invention relates generally to gas turbine engines, and, more specifically, to combustors therein.

In a gas turbine engine, air is compressed in a compressor, mixed with fuel in a combustor to generate hot combustion gases which flow downstream through one or more turbine stages which extract energy therefrom. A high pressure turbine powers the compressor, and a low pressure turbine typically powers a fan disposed upstream of the compressor for producing thrust in a turbofan engine for powering an aircraft in flight.

The combustion of fuel and air produces exhaust emissions including carbon monoxide (CO), unburned hydrocarbons (HC), smoke, and nitrogen oxides (NOx). Government regulations have become increasingly more stringent in limiting undesirable exhaust emissions in commercial aircraft. As a result thereof, gas turbine combustors undergo continual development for reducing undesirable exhaust emissions while maintaining suitable performance of the combustor and an effective useful life thereof.

For example, a significant improvement in combustor design was the introduction of double dome combustors replacing single dome combustors. Both combustors include an annular radially outer combustor liner spaced from a radially inner combustor liner, which are joined to an annular dome at upstream ends thereof.

In the single dome combustor, a single row of air swirlers and cooperating fuel injectors is mounted around the circumference of the dome for providing a number of fuel and air injection sites for generating the combustion gases. The combustor liners are air cooled using various forms of film cooling, and also include one or more rows of dilution air holes through which additional air is injected into the combustion gases for dilution thereof and producing desired radial and circumferential temperature profiles and pattern factors at the outlet of the combustor.

The double dome combustor includes two radially spaced apart rows of air swirlers and fuel injectors in the dome, with a cooperating annular centerbody extending downstream from the dome between the two rows to define two local combustion zones, i.e., an outer pilot zone, and an inner main zone. The double dome combustor is substantially shorter in axial length than a comparable single dome combustor and includes substantially more fuel injection sites for greatly reducing undesirable exhaust emissions.

However, the double dome combustor is substantially more complex than the single dome combustor, includes more components, and is operated differently for achieving low exhaust emissions, in particular CO, HC, and NOx, with suitable efficiency in operating performance over a varying power range from low-power idle to high-power takeoff in an aircraft engine application. Since the swirlers are fixed flow-area devices, they may be sized optimally at only one design point over the entire operating range of the combustor.

Air flow through the swirlers increases with increasing flow rate of the compressor air over the increasing power settings of the engine. And, the fuel to the corresponding fuel injectors may also be varied over the operating range of the combustor for varying the resulting fuel to air ratio for acceptable performance. A stoichiometric fuel to air ratio is a theoretical ratio for complete combustion, with lower ratios being considered lean, and higher ratios being considered rich. Rich combustion improves engine operability, whereas lean combustion reduces exhaust emissions and is limited to prevent lean blowout of the combustion gases.

Accordingly, in order to effectively operate a lean double dome combustor over its entire operating range, fuel staging between the pilot and main zones is required. Correspondingly, the outer fuel injectors of the pilot zone are separately joined to a common distributing fuel manifold for providing fuel thereto. And, the radially inner fuel injectors of the main zone are joined to one or more independent fuel manifolds for providing fuel thereto. In a typical application, a complex and expensive main staging valve controls fuel flow to the pilot and main fuel injectors. The main injectors may be arranged in two groups each fed by a common fuel manifold requiring a second staging valve to control fuel flow thereto.

In operation, only the pilot fuel injectors are provided with fuel at idle for enhancing ignition capability and reducing exhaust emissions at idle, with the main fuel injectors being provided with fuel above idle in stages up to full power operation of the combustor. The pilot and main swirlers are typically sized for achieving substantially complete combustion with the respective portions of the fuel injected therein, with the one or more rows of dilution holes providing quenching of the combustion gases to control the discharge temperature profiles thereof.

However, at idle, the main fuel injectors are off while air still flows through the corresponding inner swirlers into the combustor. An axially elongate centerbody is therefore required between the pilot and main swirlers and is attached to the dome for separating the two local pilot and main combustion zones for permitting effective operation of the combustor.

In view of the different operating requirements of the pilot and main fuel injectors and swirlers, the main injectors and swirlers are considerably larger in size and flow rate capability than the pilot injectors and swirlers in order to provide the considerable flow rates required for high power operation of the combustor. This, too, also increases the complexity of the combustor design and its operation.

In view of the complexity of the staged double dome combustor, it is desired to decrease the complexity thereof while achieving further reductions in exhaust emissions.

BRIEF SUMMARY OF THE INVENTION

A gas turbine engine combustor includes outer and inner liners joined together at an annular dome. Outer and inner air swirlers and cooperating fuel injectors are mounted in two rows in the combustor dome. The fuel injectors are joined to a common fuel manifold for simultaneously channeling fuel thereto over an operating range from idle to full power for reducing exhaust emissions.

BRIEF DESCRIPTION OF THE DRAWING

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
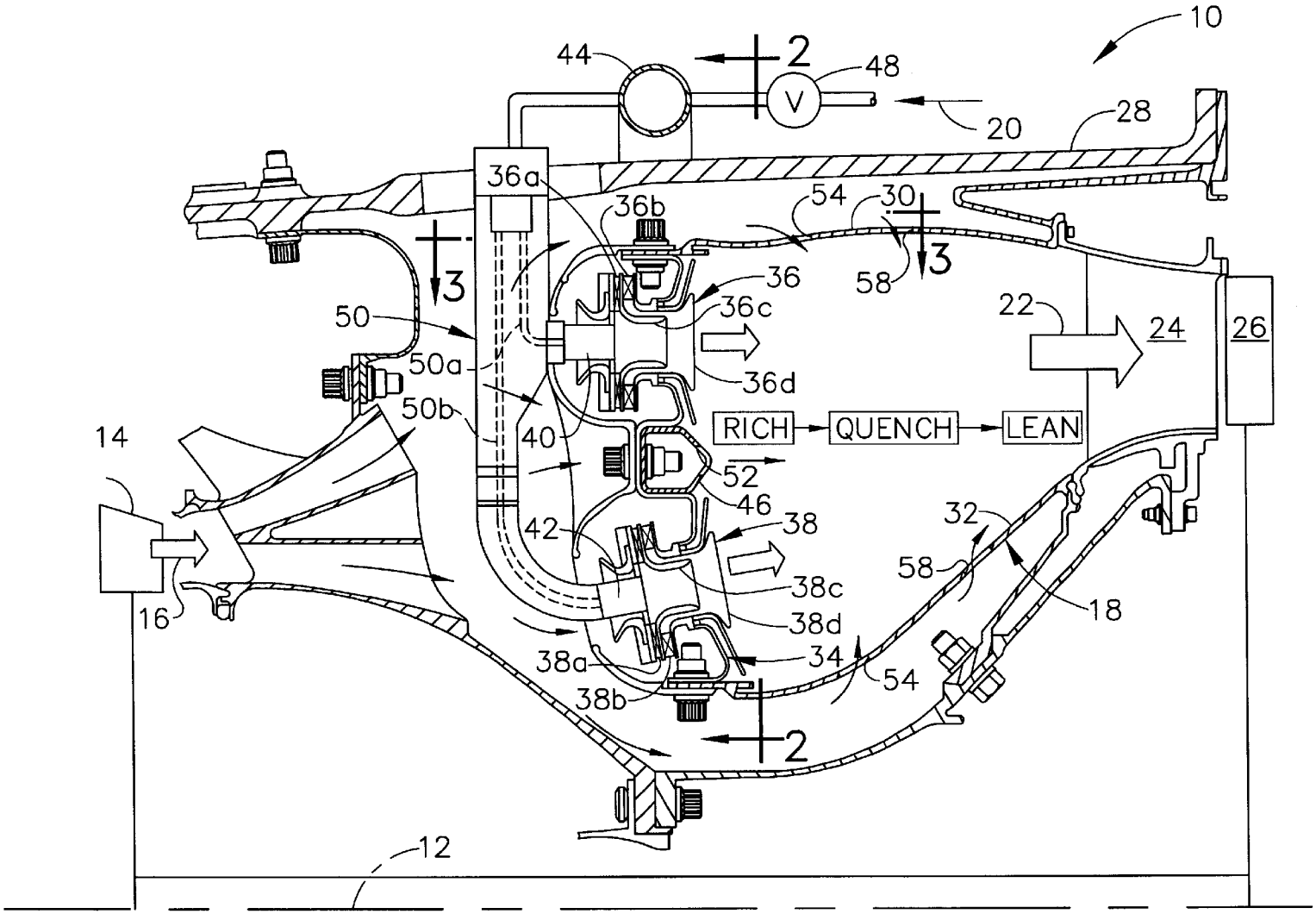
FIG. 1 is a schematic, partly section axial view of a portion of a turbofan aircraft gas turbine engine including a double dome combustor in accordance with an exemplary embodiment of the present invention.

Illustrated schematically in FIG. 1 is a portion of a turbofan aircraft gas turbine engine 10 which is axisymmetrical about a longitudinal or axial centerline axis 12. The engine includes a multistage axi-centrifugal compressor 14 which provides compressed air 16 to a double dome combustor 18 in accordance with an exemplary embodiment of the present invention.

The air 16 is mixed with fuel 20 and suitably ignited for generating hot combustion gases 22 which are discharged from the combustor through a high pressure turbine nozzle 24 to a row of high pressure turbine blades 26 extending from a rotor disk joined to the compressor 14 for the powering thereof. The combustion gases 22 also flow downstream to a low pressure turbine (not shown) which powers a fan (not shown) disposed upstream of the compressor 14 for producing thrust and powering an aircraft in flight in an exemplary embodiment.

The combustor 18 is suitably mounted inside an annular combustor casing 28 joined in flow communication with the diffuser outlet of the compressor 14 for receiving the compressed air 16 therefrom. The combustor includes an annular radially outer liner 30 spaced radially outwardly from and coaxially with an annular radially inner liner 32 defining therebetween a combustion zone through which the combustion gases burn and flow downstream to the nozzle 24.

The outer and inner liners 30,32 are fixedly joined at their forward or upstream ends to an annular double dome 34, with the aft or downstream ends of the liners defining a combustor outlet for discharging the combustion gases to the nozzle 24.

Figure 2:
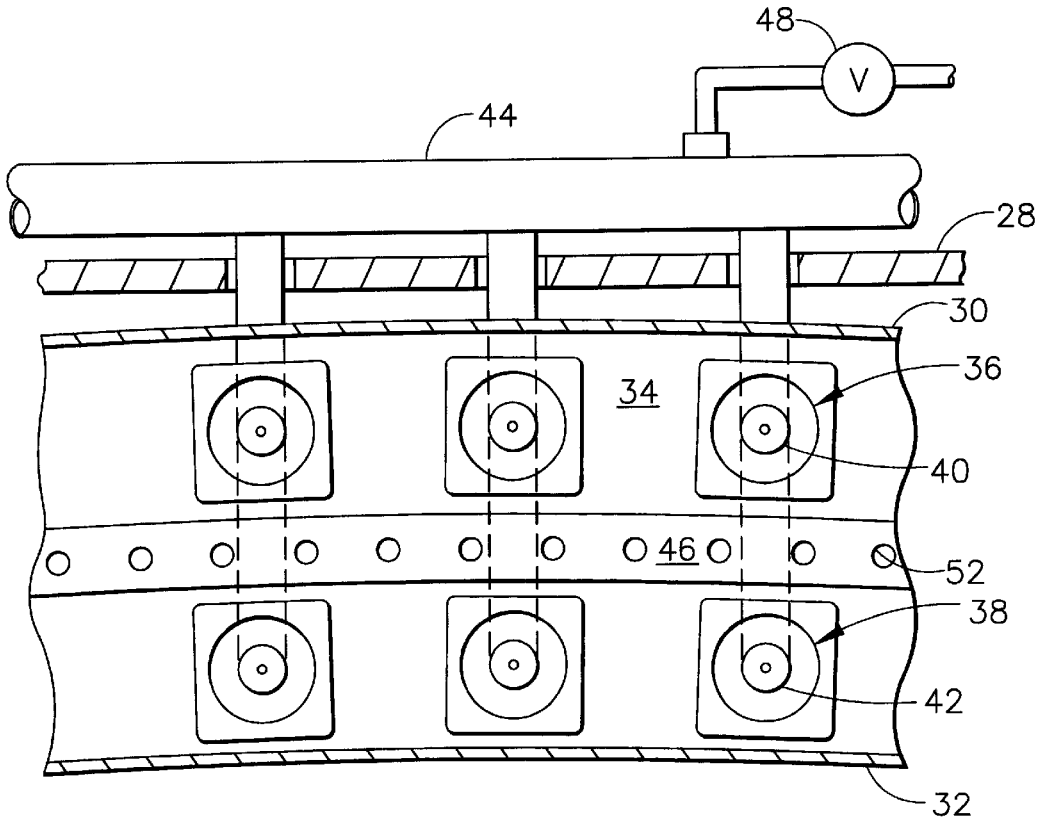
FIG. 2 is a radial sectional elevation view through a portion of the combustor illustrated in FIG. 1 and taken along line 2—2.

As additionally shown in FIG. 2, the combustor also includes a plurality of stationary radially outer and inner air swirlers 36,38 mounted at corresponding apertures in the dome 34 in two radially spaced apart rows thereof. The swirlers may have any conventional configuration, and in the exemplary embodiment illustrated in FIG. 1 each includes two rows of circumferentially spaced apart inclined vanes 36*a,b* and 38*a,b* separated by a coaxial, annular venturi 36*c* and 38*c*. The swirl vanes may be configured for either co-rotation or counterrotation of respective portions of the compressed air 16 for flow into the combustor.

The combustor also includes a plurality of outer and inner fuel injectors or nozzles 40,42 slidingly mounted in respective ones of the outer and inner swirlers 36,38. The fuel injectors 40,42 may have any conventional configuration such as pressure atomizing nozzles for injecting the fuel 20 at each of the sites corresponding with the swirlers for mixing with the swirled air to form a fuel and air mixture which is ignited by an igniter (not shown) for undergoing combustion to generate the hot combustion gases 22 produced by the combustor during operation.

The swirlers 36,38 and injectors 40,42 define two radially spaced apart rows of circumferentially spaced apart fuel and air injection sites in the double dome 34 for injecting discrete fuel and air mixtures for undergoing combustion. The individual injectors 40,42 define means for injecting corresponding portions of the total required fuel into the combustor, with the swirlers 36,38 defining corresponding means for swirling portions of the compressed air 16 around the injected fuel for mixing therewith and producing combustible fuel and air mixtures.

In accordance with the present invention, an annular fuel manifold 44 is joined in flow communication with the outer and inner fuel injectors 40,42 in both outer and inner rows for simultaneously channeling the fuel 20 thereto over a combustor operating power range from idle at substantially minimum power to substantially fully power, at take-off for example, for correspondingly producing the combustion exhaust gases 22 with lower exhaust emissions including smoke, CO, HC, and NOx. A significant feature of the present invention is that the double dome combustor 18 does not utilize staged fueling between the radially outer and inner rows, which rows, instead are fueled throughout the normal operating range of the combustor from idle to take-off.

Since the outer and inner fuel injectors are fueled full time over the normal operating range, substantial reductions in complexity and cost of the combustor and its fuel system may be obtained with enhanced reductions of undesirable exhaust emissions. For example, the combustor illustrated in FIG. 1 is characterized by the absence of the typical axially elongate centerbody between the outer and inner rows, with a short annular centershield 46 instead being used which is substantially short in axial length or projection from the dome 34.

As shown in FIG. 1, the centershield 46 is fixedly joined to the dome 34 radially between the outer and inner swirlers 36,38, and terminates substantially coplanar or coextensively with corresponding outlets 36*d*,38*d* of the swirlers for allowing unobstructed cross-fire therebetween in one common combustion zone defined between the outer and inner liners. Since the inner injectors 42 are operated full time with the outer injectors 40, no elongate centerbody is required to separate the outer portion of the combustion zone from the inner portion thereof.

Since fuel is provided simultaneously to both rows of fuel injectors during normal operation, only a single manifold 44 is required in a basic embodiment, with a corresponding single fuel flow regulating valve 48 operatively joined to the manifold 44.

As shown in FIGS. 1 and 2, a pair of the outer and inner fuel injectors 40,42 may be radially aligned with each other and supported from a common fuel injector stem 50 having one or more internal conduits 50*a,b* joining the respective injectors to the common manifold 44. In this way, the fuel from the common manifold 44 may be simultaneously channeled to each of the outer and inner fuel injectors 40,42 through each of the stems 50.

If desired, however, the outer and inner fuel injectors may be staged circumferentially using another manifold like manifold 44 for allowing sub-idle operation without flame-out. In such an embodiment, the outer and inner fuel injectors at each of the stems 50 are nevertheless joined to a common manifold for simultaneous delivery of fuel thereto when required at selected ones of the stems.

In a preferred embodiment, the outer and inner swirlers 36,38 are sized for delivering or channeling at idle substantially full combustion air for mixing with the fuel for undergoing combustion. In this way, the outer and inner swirlers deliver 100% theoretical or stoichiometric air at idle for enhanced operability with low exhaust emissions.

Since the swirlers are fixed area devices, the idle-sized flow areas thereof effect incomplete combustion air at above-idle operating power. For example, the outer and inner swirlers may be sized to channel about 50% theoretical or stoichiometric air at the aircraft take-off power requirement. Although the swirlers are fixed-area devices, the air flow therethrough necessarily increases as the flowrate of the compressed air 16 from the compressor 14 increases from idle to full power. However, for above idle operation, additional combustion air is required outside the outer and inner swirlers.

For example, the axially short centershield 46 may be additionally used to advantage by including a plurality of circumferentially spaced apart first holes 52 for channeling additional combustion air to complement the swirler air above idle. The centershield includes inlets at its forward end which receive a portion of the compressed air 16 from the compressor and which is injected axially downstream into the combustor through the first holes 52. The centershield may include small holes (not shown) for providing film cooling thereof, with such film cooling holes typically being about 20–30 mils in diameter. In contrast, the first holes 52 are substantially larger in size and may be in the range of about 200–400 mils in diameter for injecting the compressed air for use in complementing the incomplete combustion air from the swirlers themselves, as well as quenching and diluting the combustion gases in controlling the desired temperature profiles at the combustor outlet.

Figure 3:
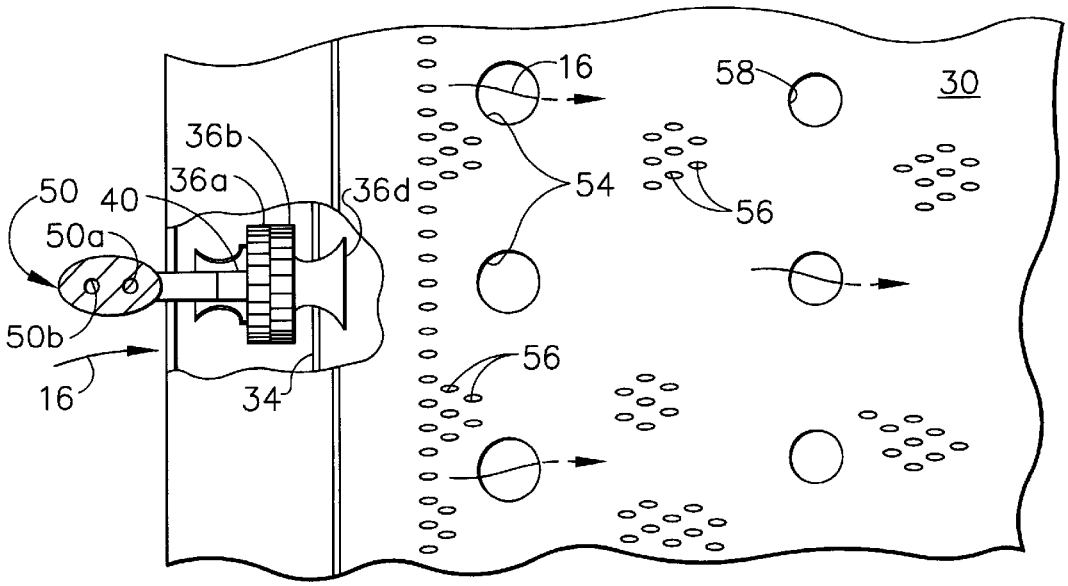
FIG. 3 is a partly sectional top view of a portion of the combustor illustrated in FIG. 1 and taken along line 3—3.

As shown in FIGS. 1 and 3, the combustor preferably also includes a plurality of second holes 54 extending in rows through the outer and inner liners 30,32 at forward ends thereof downstream of the combustor dome for channeling additional combustion air to further complement the swirler air above idle. In the exemplary embodiment illustrated in FIG. 3, the liners 30,32 themselves are effectively film cooled using a closely spaced pattern of multiholes 56 which may take any conventional configuration, and are shown in part. The multiholes 56 are typically inclined radially through the liners in the downstream direction at about 20°–30° and have diameters of about 20 mils. In contrast, the second holes 54 are substantially larger in diameter in the exemplary range of 300–500 mils for effecting radially inwardly extending jets of the compressed air for completing combustion and quenching the exhaust gases 22 prior to discharge from the combustor.

The combustor may also include a plurality of circumferentially spaced apart third holes 58 spaced downstream from the row of second holes 54 for providing additional jets of dilution air for further controlling the temperature profiles at the combustor outlet.

Another significant advantage of simplifying the configuration and reducing the number of components of the combustor is that the outer and inner swirlers 36,38 may be sized and configured to be identical in operation and in flowrate capability. And, the outer and inner fuel injectors 40,42 may also be identical in size, configuration, and flowrate capability. Accordingly, a single swirler design, and a single fuel injector design may be used at all of the fuel injection sites defined by the cooperating injectors and swirlers. And, most significantly, this is effected without fuel staging radially between the rows of injection sites.

This improved, simplified structure of the double annular combustor 18 allows an improved method of operation thereof. The combustor may be operated by channeling at idle substantially full combustion air through the outer and inner swirlers 36,38 and mixing therewith fuel from the corresponding outer and inner injectors 40,42. And, at full power, incomplete combustion air is channeled through the outer and inner swirlers and mixed with the fuel from the outer and inner fuel injectors.

The incomplete swirler combustion air may be complemented by channeling additional combustion air through the dome 34 and out the first holes 52 of the centershield 46, and through the second holes 54 in the outer and inner liners 30,32 above idle.

Not only is the combustor 18 simplified in construction, but it may be operated to advantage for further reducing undesirable exhaust emissions while maintaining effective combustor capability from ignition, to idle, to full power, and under altitude relight in an aircraft application. For a given flowrate of the compressed air through the outer and inner swirlers 36,38 at idle, the outer and inner fuel injectors 40,42 may be provided with a suitable flowrate of fuel for effecting a substantially stoichiometric, or near stoichiometric, fuel and air mixture and combustion thereof to reduce smoke, CO, and HC exhaust emissions.

At above idle operation, the fuel injectors 40,42 and cooperating swirlers 36,38 may be operated locally rich adjacent the dome 34, with additional combustion air being channeled through the first and second holes 52,54 to not only quench the combustion gases but dilute them lean for reducing NOx emissions. As shown in FIG. 1, the combustion gases beginning immediately downstream of the outer and inner swirlers 36,38 may be relatively rich in fuel to air ratio and quickly quenched to a lean stoichiometry in a rich-quench-lean (RQL), or rich dome, mode of operation whereby residence time at high temperature stoichiometries is minimized thusly reducing NOx production.

The double annular combustor disclosed above includes many advantages including improved fuel and air mixing with the multiple rows of fuel injectors and swirlers which can provide twice the number of fuel injectors as compared with a single annular combustor of greater axial length. The shorter length double annular combustor is also effective for providing a substantially uniform exit temperature of the combustion gases for enhanced turbine performance and durability.

Since all of the fuel injectors in the two rows are operated from idle to full power, virtually smoke-free operation over the entire power range may be obtained as compared to previous single and double dome combustors.

The use of the rich dome combustor results in high efficiency and low CO and HC exhaust emissions at idle relative to a conventional lean-dome double annular combustor having staged fuel flow. Correspondingly, at high power, NOx emissions are controlled and reduced by the RQL combustion process having low residence time at high temperature. The short centershield allows common combustion between the outer and inner portions of the combustion zone, and is effective in reducing NOx emissions and controlling the gas temperature exit profiles from the combustor without adversely affecting combustor operability.

The rich dome double annular combustor described above has additional advantages over a conventional lean-dome double annular combustor. For example, the rich dome combustor eliminates the outboard peaked pilot-only exit temperature profile associated with lean-dome double annular combustors. In the radially fuel-staged conventional double dome combustor, only airflow, without fuel, is found in the inner, main zone at idle which peaks the combustion gas temperature profile radially outwardly and may cause increased fuel burn, slow engine start times due to reduced turbine efficiency, turbine temperature distress, and exhaust gas temperature overshoot. Further reductions in low-power exhaust emissions are obtained by eliminating the quenching of the pilot combustion gases by the non-burning main air.

The elimination of the extended centerbody by a relatively short centershield reduces cooling requirements therefor resulting in lower exhaust emissions; improves the inner zone lightoff capability by ignition from the outer zone; and significantly reduce costs of manufacture. Since the centerbody is eliminated, cross-fire thereover is also eliminated and attendant problems therewith such as engine operability and control complexity.

The complexity and cost of both the fuel delivery system and control system are substantially reduced by using the common fuel injectors for both the inner and outer rows. The substantially expensive main staging valve used in a conventionally staged double annular combustor is eliminated, along with corresponding fuel manifolds therefor. And, the fuel injector stems are also substantially simplified by requiring a single fuel inlet for simultaneously feeding both outer and inner fuel injectors, using a common control valve for regulating the fuel thereto.

Since the outer and inner fuel injectors are operated simultaneously over the normal operating range of the combustor from idle to maximum power, one or more staging modes above idle operation are correspondingly eliminated, along with the fuel delivery equipment therefor and associated control requirements.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims.

What is claimed is:

1. A gas turbine engine combustor comprising:

an annular outer liner spaced from an annular inner liner, and joined at forward ends to an annular dome;

a plurality of outer and inner air swirlers, mounted at apertures in said dome in two radially spaced apart rows;

a plurality of outer and inner fuel injectors, mounted in respective ones of said outer and inner swirlers; and means including a fuel manifold joined in flow communication with both said outer and inner fuel injectors for simultaneously channeling fuel thereto over an operating range from idle to substantially full power for producing combustion exhaust gases.

2. A combustor according to claim 1 further comprising a centershield joined to said dome radially between said outer and inner swirlers, and terminating substantially coextensively with outlets of said outer and inner swirlers for allowing unobstructed cross-fire therebetween.

3. A combustor according to claim 2 wherein said outer and inner swirlers are sized for channeling at idle substantially full combustion air for mixing with said fuel, and incomplete combustion air at full power.

4. A combustor according to claim 3 further comprising a plurality of first holes in said centershield for channeling additional combustion air to complement said swirler air above idle.

5. A combustor according to claim 4 further comprising a plurality of second holes adjacent forward ends of said outer and inner liners for channeling additional combustion air to complement said swirler air above idle.

6. A combustor according to claim 5 wherein:

said outer and inner swirlers are identical; and said outer and inner fuel injectors are identical.

7. A method of operating said combustor accordingly to claim 2 comprising:

channeling at idle substantially full combustion air through said outer and inner swirlers and mixing therewith fuel from said outer and inner injectors; and channeling at full power incomplete combustion air through said outer and inner swirlers and mixing therewith fuel from said outer and inner injectors.

8. A method according to claim 7 further comprising channeling additional combustion air through said dome and liners to complement said swirler air above idle.

9. A method according to claim 8 further comprising operating said injectors and swirlers near stoichiometric at idle to reduce smoke, unburned hydrocarbons, and carbon monoxide emissions.

10. A method according to claim 9 further comprising operating said injectors and swirlers above idle locally rich adjacent said dome, and channeling said additional combustion air to quench and lean said combustion gases to reduce NOx emissions.

11. A gas turbine engine combustor comprising outer and inner liners joined together at an annular dome having two rows of radially outer and inner air swirlers, and means for simultaneously injecting fuel through both swirler rows without outer and inner fuel staging therein over an operating range from idle to substantially full power.

12. A combustor according to claim 11 wherein said outer and inner swirlers are sized for channeling at idle substantially full combustion air for mixing with said fuel, and incomplete combustion air at full power.

13. A combustor according to claim 12 further comprising means for channeling additional air through said dome to complement said swirler air above idle.

14. A combustor according to claim 13 wherein said air channeling means comprise a centershield disposed in said dome between said swirler rows, and having a row of first holes sized for channeling said additional air therethrough.

15. A combustor according to claim 14 wherein said air channeling means further comprise rows of second holes in said outer and inner liners for channeling said additional air therethrough.

16. A combustor according to claim 13 wherein said outer and inner swirlers are sized for substantially identical air flowrate capability.

17. A method of operating said combustor according to claim 11 comprising;

channeling at idle substantially full combustion air through said outer and inner swirlers and mixing therewith said fuel; and channeling at full power incomplete combustion air through said outer and inner swirlers and mixing therewith said fuel.

18. A method according to claim 17 further comprising channeling additional combustion air through said dome and liners to complement said swirler air above idle.

19. A method according to claim 18 further comprising injecting said fuel into said swirler air to operate said combustor near stoichiometric at idle to reduce smoke, unburned hydrocarbons, and carbon monoxide emissions.

20. A method according to claim 19 further comprising injecting said fuel into said swirler air to operate said combustor locally rich above idle adjacent said dome, and channeling said additional combustion air to quench and lean said combustion gases to reduce NOx emissions.

* * * * *

UNITED STATES PATENT AND TRADEMARK OFFICE

CERTIFICATE OF CORRECTION

PATENT NO. : 6,474,070 B1
DATED : November 5, 2002
INVENTOR(S) : Danis et al.

It is certified that error appears in the above-identified patent and that said Letters Patent is hereby corrected as shown below:

Title page,
Insert -- [*] Notice: Under 35 U.S.C. 154(b), the term of this patent shall be extended for 291 days. --.

Signed and Sealed this

Third Day of December, 2002

JAMES E. ROGAN
*Director of the United States Patent and Trademark Office*